US010971849B2

(12) United States Patent
Ohta

(10) Patent No.: US 10,971,849 B2
(45) Date of Patent: Apr. 6, 2021

(54) CONNECTOR AND CONNECTOR ASSEMBLY

(71) Applicant: 3M INNOVATIVE PROPERTIES COMPANY, St. Paul, MN (US)

(72) Inventor: Toshio Ohta, Sagamihara (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 16/607,913

(22) PCT Filed: Jun. 20, 2018

(86) PCT No.: PCT/IB2018/054557
§ 371 (c)(1),
(2) Date: Oct. 24, 2019

(87) PCT Pub. No.: WO2019/003057
PCT Pub. Date: Jan. 3, 2019

(65) Prior Publication Data

US 2020/0185855 A1 Jun. 11, 2020

(30) Foreign Application Priority Data

Jun. 30, 2017 (JP) ..... JP2017-129636

(51) Int. Cl.
*H01R 13/506* (2006.01)
*H01R 13/508* (2006.01)
(Continued)

(52) U.S. Cl.
CPC ..... *H01R 13/506* (2013.01); *H01R 13/508* (2013.01); *H01R 13/514* (2013.01); *H01R 25/006* (2013.01)

(58) Field of Classification Search
CPC .. H01R 4/2433; H01R 13/506; H01R 12/616; H01R 13/582; H01R 4/2425;
(Continued)

(56) References Cited

U.S. PATENT DOCUMENTS 5,498,172 A * 3/1996 Noda ..... H01R 12/616 439/404
6,270,372 B1 * 8/2001 Jenner ..... H01R 4/2429 439/405
(Continued)

FOREIGN PATENT DOCUMENTS

CN 204885524 U 12/2015
DE 10 2016 212 631 1/2017
(Continued)

OTHER PUBLICATIONS

PCT International Search Report from PCT/IB2018/054557, dated Nov. 13, 2018, 7 pages.

*Primary Examiner* — Edwin A. Leon
*Assistant Examiner* — Matthew T Dzierzynski
(74) *Attorney, Agent, or Firm* — Robert S. Moshrefzadeh

(57) ABSTRACT

A connector (1000) includes a housing (100), a cover (200), and a plurality of contacts (300). The housing (100) includes a housing front portion (10) having a plurality of first groove portions (20) and a housing rear portion (30) having a plurality of second groove portions (40) and a plurality of third groove portions (50) offset from the first groove portions (20). The cover (200) is configured to be combined with the housing front portion (10) and includes a plurality of fourth groove portions (210) including through holes (211). Each contact (300) includes a pressure connection portion (320) disposed in a corresponding through hole (211) and configured to contact a wire (370) inserted into the cover (200), a first section (310) disposed in the corresponding first groove portion (100, 20A, 20B, 20C, 20D, 20, 210,
(Continued)

211, 250, 30, 40, 50), a second section (310, 320, 330, 350, 370) disposed in the corresponding second groove portion (20) and including a first contact portion (340) at an end, and a third section (350) disposed in the corresponding third groove portion (50) and including a second contact portion (360) at an end.

17 Claims, 12 Drawing Sheets

(51) Int. Cl.
*H01R 13/514* (2006.01)
*H01R 25/00* (2006.01)

(58) Field of Classification Search
CPC ..... H01R 12/675; H01R 2107/00; H01R 4/2429; H01R 11/05; H01R 13/112; H01R 13/64; H01R 4/242; H01R 13/025; H01R 13/04
See application file for complete search history.

(56) References Cited

U.S. PATENT DOCUMENTS

| | | | | |
|---|---|---|---|---|
| 6,398,581 | B1 * | 6/2002 | Baier | H01R 12/616 439/404 |
| 6,837,737 | B2 * | 1/2005 | Baier | H01R 12/616 439/402 |
| 7,074,093 | B2 * | 7/2006 | Saka | H01R 31/085 439/417 |
| 7,494,364 | B2 * | 2/2009 | Sakamoto | H01R 4/2429 439/395 |
| 7,503,797 | B2 * | 3/2009 | Lappoehn | H01R 4/2445 439/404 |
| 7,934,941 | B2 * | 5/2011 | Hayauchi | H01R 4/2433 439/417 |
| 8,105,105 | B2 * | 1/2012 | Taniguchi | H01R 4/2425 439/395 |
| 8,403,708 | B2 * | 3/2013 | Ohta | G01R 1/0416 439/620.04 |
| 9,209,545 | B2 * | 12/2015 | Hemmi | H01R 4/2462 |
| 9,231,316 | B2 * | 1/2016 | Hemmi | H01R 4/242 |
| 9,231,324 | B2 * | 1/2016 | Hemmi | H01R 4/242 |
| 9,343,838 | B2 * | 5/2016 | Jove Albos | H01R 13/504 |
| 10,020,598 | B2 * | 7/2018 | Lappoehn | H01R 13/582 |
| 10,074,914 | B2 * | 9/2018 | Lappoehn | H01R 13/112 |
| 10,218,112 | B2 * | 2/2019 | Luttermann | H01R 13/506 |
| 10,476,179 | B2 * | 11/2019 | Hayashi | H01R 4/2433 |
| 2010/0167579 | A1 | 7/2010 | Hayauchi | |
| 2020/0185855 | A1 * | 6/2020 | Ohta | H01R 11/05 |
| 2020/0303842 | A1 * | 9/2020 | Ohta | H01R 4/2433 |

FOREIGN PATENT DOCUMENTS

| | | |
|---|---|---|
| EP | 1 575 136 | 9/2005 |
| JP | 2652432 | 9/1997 |
| JP | 2003-173827 | 6/2003 |

* cited by examiner

CONNECTOR AND CONNECTOR ASSEMBLY

TECHNICAL FIELD

The present invention relates to a connector, a connector assembly, and a contact.

BACKGROUND ART

There has been a connector described in Patent Document 1, for example. The known connector includes a cable housing in which a cable can be temporarily fixed between an upper cable housing and a lower cable housing and a contact housing in which a contact including a U-shape pressure contacting portion is disposed. The upper cable housing and the lower cable housing each have an upper guide slot and a lower guide slot. The cable is pressure welded by the U-shape pressure contacting portion between the upper and lower guide slots.

PRIOR ART DOCUMENTS

Patent Documents

Patent Document 1: JP 2003-173827 A

SUMMARY OF THE INVENTION

Problem to be Solved by the Invention

In the known connector described above, a pair of connectors having a socket shape and a plug shape are connected to each other, thereby connecting cables to each other. Thus, as in a case where a floodlight lamp and a photodetector are connected to a programmable controller, for example, cables according to the number of sensors need to be wired when a plurality of sensors are connected to one apparatus. In this case, more cables sometimes make wiring more complicated.

In one aspect, an object is to provide a connector capable of suppressing complicated wiring, a connector assembly, and a contact.

Means for Solving the Problem

A connector of one aspect includes a housing, a cover, and a plurality of contacts. The housing includes a housing front portion including a plurality of first groove portions disposed to be adjacent to each other, and a housing rear portion including a plurality of second groove portions offset from and located above the plurality of first groove portions and disposed to be adjacent to each other and a plurality of third groove portions offset from and located below the plurality of first groove portions and disposed to be adjacent to each other. The cover is configured to be combined detachably with the housing front portion, includes a plurality of fourth groove portions disposed to be adjacent to each other, and includes a through hole penetrating from a top surface of each of the plurality of fourth groove portions to a bottom surface of the cover. Each of the plurality of contacts includes: a pressure connection portion disposed in the through hole of a corresponding fourth groove portion among the plurality of fourth groove portions and configured to come in contact with a wire; a first section connected to the pressure connection portion and disposed in a corresponding first groove portion among the plurality of first groove portions; a second section connected to the first section, disposed in a corresponding second groove portion among the plurality of second groove portions, and including, at an end, a first contact portion that comes in contact with a corresponding terminal of a first engagement connector configured to be engaged with the housing rear portion; and a third section connected to the first section, disposed in a corresponding third groove portion of the plurality of third groove portions, and includes, at an end, a second contact portion that comes in contact with a corresponding terminal of a second engagement connector configured to be engaged with the housing rear portion.

In one embodiment, the housing may have a configuration in which the housing front portion and the housing rear portion are integrated.

In one embodiment, the housing may include a central wall portion located between the housing front portion and the housing rear portion. A plurality of openings communicating with the plurality of first groove portions and disposed to be adjacent to each other may be formed in the central wall portion.

In one embodiment, each of the plurality of openings may have a C shape or an inverted C shape.

In one embodiment, each of the plurality of contacts may further include a holding portion configured to hold and fix each of the plurality of contacts in the housing. The holding portion may be disposed in a corresponding opening among the plurality of openings in the central wall portion.

In one embodiment, the holding portion of each of the plurality of contacts may have a C shape or an inverted C shape.

In one embodiment, in at least a pair of a first contact and a second contact adjacent to each other of the plurality of contacts, a holding portion of the first contact may have a C shape forming a recessed portion, a holding portion of the second contact may have an inverted C shape forming a recessed portion, and the recessed portion of the holding portion of the first contact and the recessed portion of the holding portion of the second contact may face each other.

In one embodiment, the cover may include a cover lower portion including the plurality of fourth groove portions formed in the cover lower portion and a cover upper portion disposed on the cover lower portion.

In one embodiment, the cover upper portion may include a latch configured to engage the cover upper portion with the housing front portion. The cover lower portion may be configured to be fixed between the cover upper portion and the housing front portion by engagement of the latch.

In one embodiment, the latch may be configured to be engaged with an engagement portion of the housing front portion.

In one embodiment, the cover may further include fifth groove portions disposed to be adjacent to each other. Each of the fifth groove portions may be configured to be aligned with a corresponding fourth groove portion among the plurality of fourth groove portions and face the corresponding fourth groove portion. A hole may be formed in each of the fifth groove portions and be configured to face the through hole of the corresponding fourth groove portion, and the pressure connection portion of a corresponding contact among the plurality of contacts may be disposed in the through hole of the corresponding fourth groove portion and the hole of a corresponding fifth groove portion among the fifth groove portions.

A connector assembly in one aspect includes: the above-described connector; a plurality of first wires inserted into the cover, each of the plurality of first wires being disposed in a corresponding fourth groove portion among the plurality of fourth groove portions of the cover and being in contact with the pressure connection portion of the first section of a corresponding contact among the plurality of contacts; an upper engagement connector engaged with the connector and including a plurality of upper contacts, each of the plurality of upper contacts being in contact with the first contact portion of a corresponding contact among the plurality of contacts of the connector; and a lower engagement connector engaged with the connector and including a plurality of lower contacts, each of the plurality of lower contacts being in contact with the second contact portion of a corresponding contact among the plurality of contacts of the connector. Each of the plurality of contacts of the connector is electrically connected to a corresponding upper contact among the plurality of upper contacts and a corresponding lower contact among the plurality of lower contacts.

In one embodiment, the connector assembly may further include: a plurality of second wires inserted into the upper engagement connectors, each of the plurality of second wires being in contact with a pressure connection portion of a corresponding upper contact among the plurality of upper contacts; and a plurality of third wires inserted into the lower engagement connector, each of the plurality of third wires being in contact with a pressure connection portion of a corresponding lower contact among the plurality of lower contacts.

A contact in one aspect is a contact having electrical conductivity. The contact includes: a holding portion having a C shape or an inverted C shape when seen along an anterior-and-posterior direction, the holding portion ending with an upper end portion and a lower end portion; a first section extending forward from the upper end portion of the holding portion; a pressure connection portion extending upward from a front end of the first section and configured to accommodate a wire, and come in contact with the wire; a second section extending upward from the upper end portion of the holding portion, further extending rearward from an upper end, and ending with a first contact portion; and a third section extending downward from the lower end portion of the holding portion, further extending rearward from a lower end, and ending with a second contact portion.

In one embodiment, in a case that the contact is used in an electrically conductive connector, the first contact portion may be configured to be engaged with a corresponding contact of an upper engagement connector, and the second contact portion may be configured to be engaged with a corresponding contact of a lower engagement connector different from the upper engagement connector.

A connector in one aspect includes a housing and a plurality of contacts. The housing has an integrated configuration and includes a housing front portion configured to accommodate a plurality of wires, and a housing rear portion including a housing upper rear portion configured to be engaged with an upper engagement connector and a housing lower rear portion configured to be engaged with a lower engagement connector. Each of the plurality of contacts has an integrated configuration and includes a pressure connection portion disposed in the housing front portion, a first contact portion disposed in the housing upper rear portion, and a second contact portion disposed in the housing lower rear portion. In a case that the plurality of wires are accommodated by the housing front portion, and the housing upper rear portion and the housing lower rear portion are engaged with the upper engagement connector and the lower engagement connector, respectively, each of the plurality of contacts comes into contact with and electrically connects a corresponding wire among the plurality of wires and corresponding terminals of the upper engagement connector and the lower engagement connector to each other.

In one embodiment, the housing may include a partition wall isolating the housing upper rear portion and the housing lower rear portion from each other.

Effect of the Invention

According to the connector, the connector assembly, and the contact of one aspect, complicated wiring can be suppressed.

DESCRIPTION OF THE PREFERRED EMBODIMENTS

Figure 1:
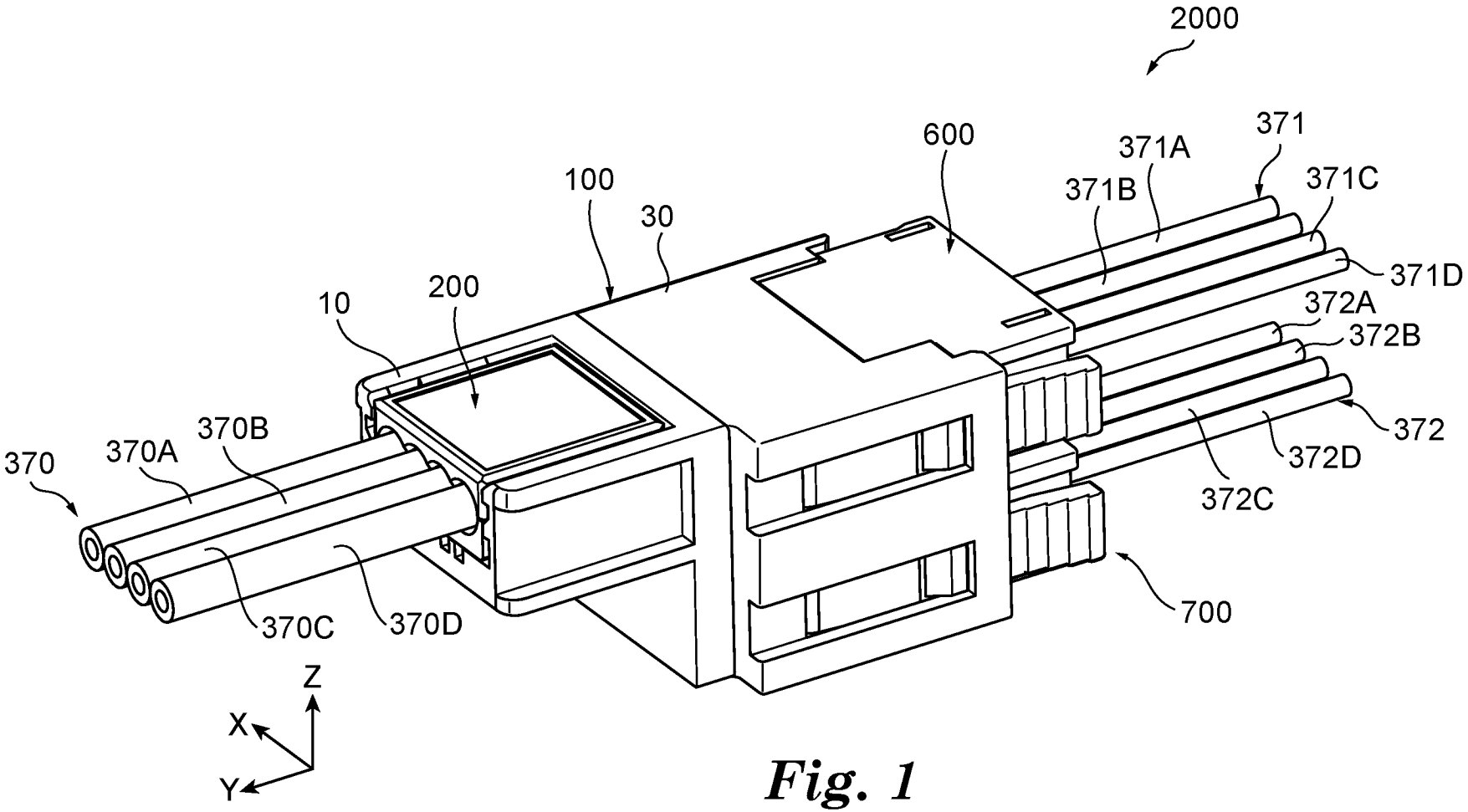
FIG. 1 is a perspective view illustrating a connector assembly according to one embodiment.

A connector of one aspect of the present invention includes a housing, a cover, and a plurality of contacts. The housing includes a housing front portion including a plurality of first groove portions disposed to be adjacent to each other, and a housing rear portion including a plurality of second groove portions offset from and located above the plurality of first groove portions and disposed to be adjacent to each other and a plurality of third groove portions offset from and located below the plurality of first groove portions and disposed to be adjacent to each other. The cover is configured to be combined detachably with the housing front portion, includes a plurality of fourth groove portions disposed to be adjacent to each other, and includes a through hole penetrating from a top surface of each of the plurality of fourth groove portions to a bottom surface of the cover. Each of the plurality of contacts includes: a pressure connection portion disposed in the through hole of a corresponding fourth groove portion among the plurality of fourth groove portions and configured to accommodate a wire inserted into the cover and come in contact with the wire; a first section connected to the pressure connection portion and disposed in a corresponding first groove portion among the plurality of first groove portions; a second section connected to the first section, disposed in a corresponding second groove portion among the plurality of second groove portions, and including, at an end, a first contact portion that comes in contact with a corresponding terminal of a first engagement connector configured to be engaged with the housing rear portion; and a third section connected to the first section, disposed in a corresponding third groove portion among the plurality of third groove portions, and including, at an end, a second contact portion that comes in contact with a corresponding terminal of a second engagement connector configured to be engaged with the housing rear portion.

In such a connector, the first groove portions formed in the housing front portion correspond to the second groove portions and the third groove portions formed in the housing rear portion. The first section of the contact disposed in the first groove portion is connected to the second section disposed in the second groove portion and the third section disposed in the third groove portion. In this way, the first section is connected to the first contact portion that comes in contact with the corresponding terminal of the first engagement connector and the second contact portion that comes in contact with the corresponding terminal of the second engagement connector. Further, the first groove portions correspond to the fourth groove portions, and the pressure connection portions connected to the first sections are disposed in the through holes provided in the fourth groove portions. While the plurality of wires corresponding to the plurality of respective fourth groove portions are inserted into the cover, each of the wires may be connected to the pressure connection portion disposed in the through hole of the corresponding fourth groove portion. In this way, the wire is electrically connected to the corresponding terminal of the first engagement connector and the corresponding terminal of the second engagement connector via the contact. Therefore, wires needed for each of the first engagement connector and the second engagement connector can be reduced, and complicated wiring can thus be suppressed.

Hereinafter, an embodiment according to the present invention will be described in detail with reference to drawings. For the sake of convenience, the same reference signs are used for substantially the same components, and description thereof may be omitted. In description, reference is made to an XYZ orthogonal coordinate system illustrated in the drawings. Note that the X-axis direction, the Y-axis direction, and the Z-axis direction may be respectively described as a left-and-right direction, an anterior-and-posterior direction, and an up-and-down direction.

Figure 2:
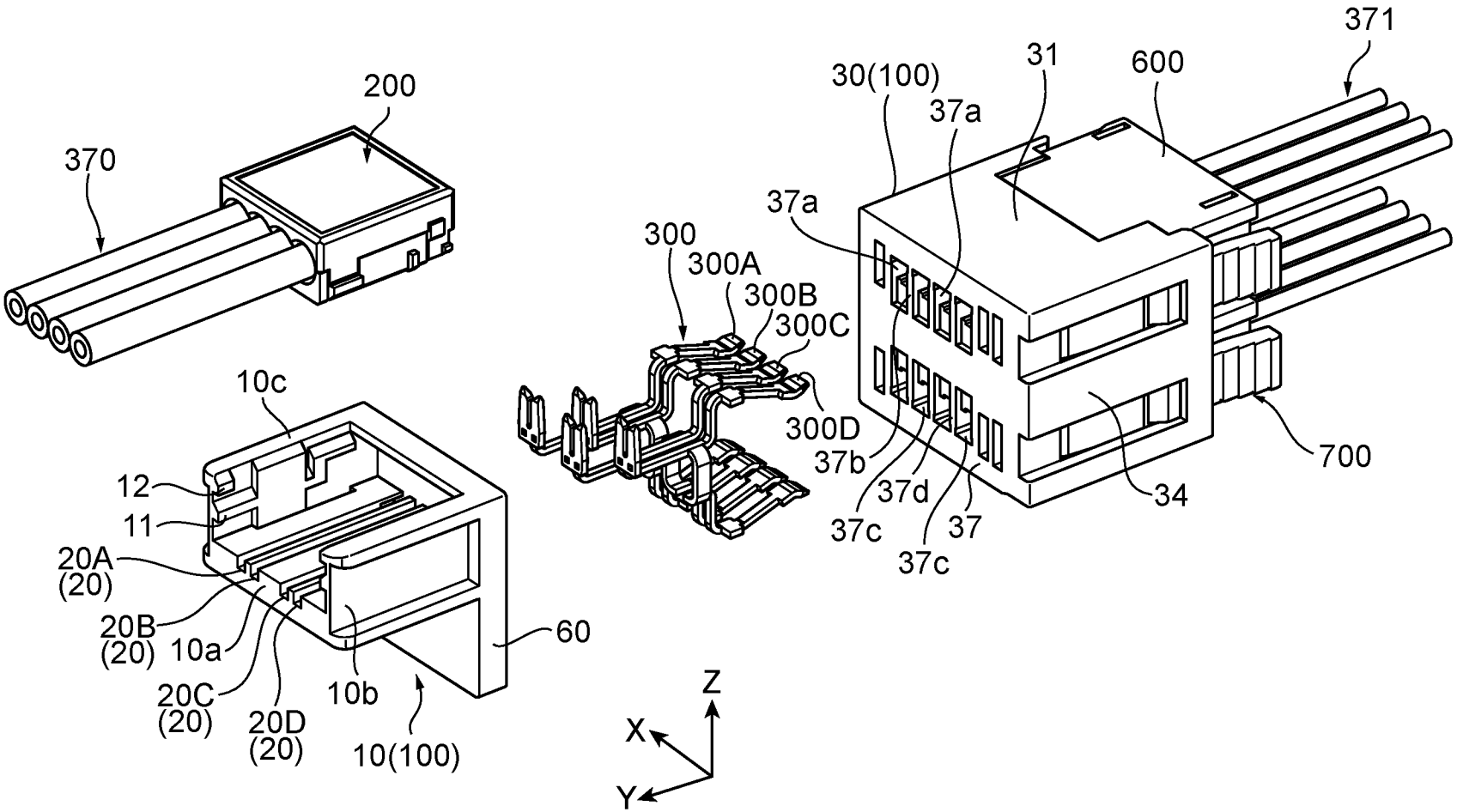
FIG. 2 is an exploded perspective view illustrating the connector assembly of FIG. 1.

FIG. 1 is a perspective view illustrating a connector assembly. FIG. 2 is an exploded perspective view illustrating the connector assembly. As illustrated in FIGS. 1 and 2, a connector assembly 2000 includes a connector 1000 including a housing 100, a cover 200, and a plurality of contacts 300, a plurality of wires (first wires) 370, an upper engagement connector 600, a plurality of wires (second wires) 371, a lower engagement connector 700, and a plurality of wires (third wires) 372.

Figure 3:
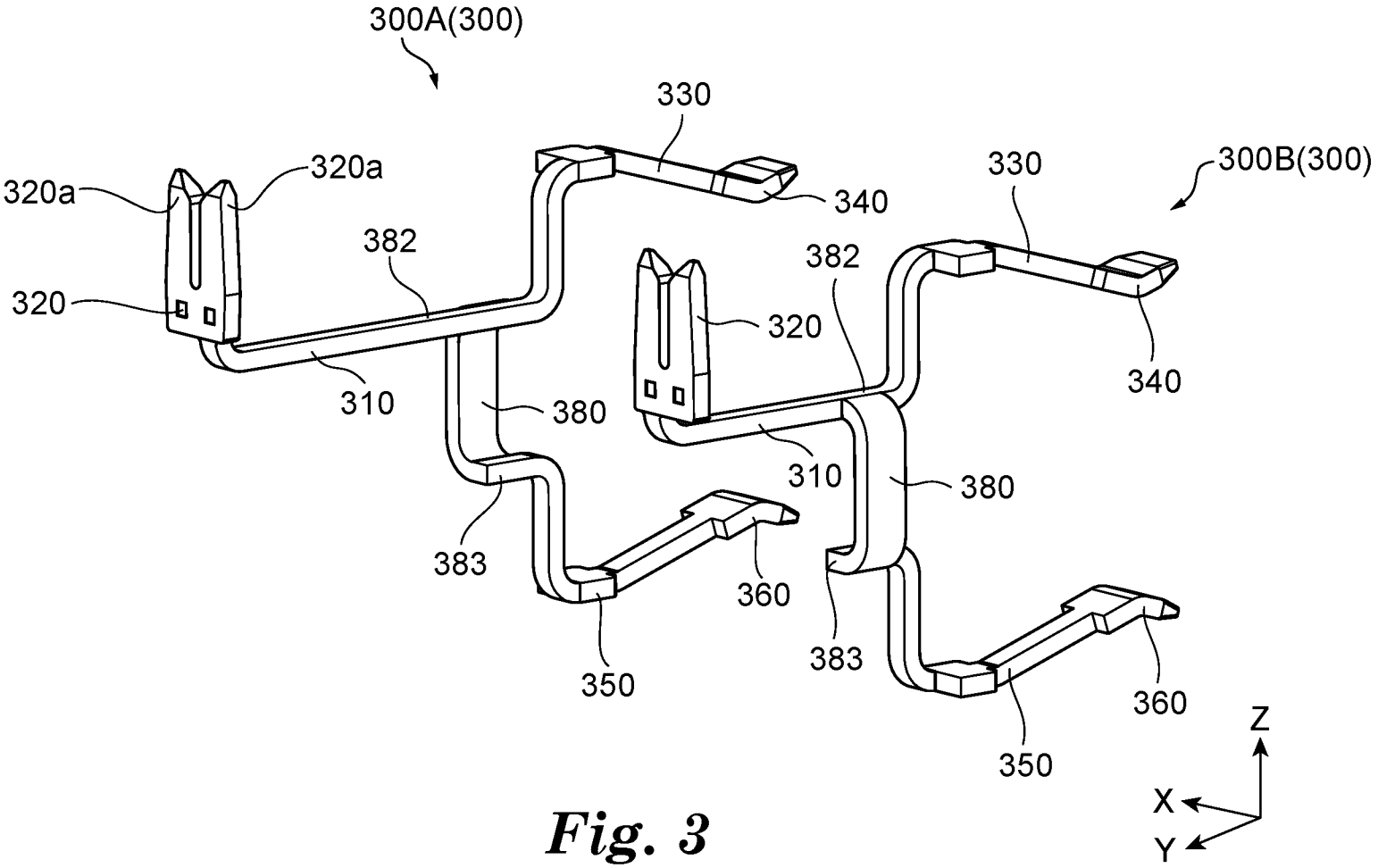
FIG. 3 is a perspective view illustrating a pair of contacts.

The plurality of contacts 300 are electrically conductive contacts and may be formed of metal having conductivity such as a copper alloy. The plurality of contacts 300 are four contacts 300A, 300B, 300C, and 300D. FIG. 3 is a perspective view illustrating a pair of the contacts 300 (for example, 300A and 300B). Each of the contacts 300 includes a pressure connection portion 320, a first section 310, a second section 330, a third section 350, and a holding portion 380. The pressure connection portion 320 includes a pair of pressure contacting blades 320*a* connected to each other at a lower end thereof. The pressure connection portion 320 has a U shape when seen from the Y-axis direction and extends upward from a front end of the first section 310. The plurality of pressure connection portions 320 are disposed in a staggered pattern. In other words, as illustrated in FIG. 2, the pressure connection portion 320 of the contact 300A and the pressure connection portion 320 of the contact 300C are located in front of the pressure connection portion 320 of the contact 300B and the pressure connection portion 320 of the contact 300D.

The first section 310 extends rearward from the lower end of the pressure connection portion 320 along the Y-axis direction. The front end of the first section 310 and the lower end of the pressure connection portion 320 are continuously formed. The second section 330 is connected to a rear end of the first section 310, and the third section 350 is also connected to the second section 330 via the holding portion 380. In one embodiment, the pressure connection portions 320 are disposed in the staggered pattern. Thus, the first section 310 of each of the contacts 300A, 300C has a length longer than the length of the first section 310 of each of the contacts 300B, 300D.

The second section 330 extends upward from the rear end of the first section 310 (that is, an upper end portion 382 of the holding portion 380), and is further curved at an upper end and extends rearward with a downward inclination. The second section 330 has a first contact portion 340 at the end. A tip of the first contact portion 340 is inclined upward.

The holding portion 380 is a portion for holding and fixing the contact 300 in the housing 100. The holding portion 380 in the illustrated example extends in the up-and-down direction. The rear end of the first section 310 and the lower end of the second section 330 are connected to an upper end of the holding portion 380. An upper end of the third section 350 is connected to a lower end of the holding portion 380. Therefore, the first section 310, the second section 330, and the third section 350 are electrically connected to one another. The holding portion 380 has a C shape or an inverted C shape ending with the upper end portion 382 and a lower end portion 383. When the pair of the contact (first contact) 300A and the contact (second contact) 300B adjacent to each other in the X-axis direction are seen toward the rear in the Y-axis direction, the holding portion 380 of the contact 300A has the C shape, and the holding portion 380 of the contact 300B has the inverted C shape. In the illustrated example, the four contacts 300A to 300D are disposed. A recessed portion formed by the C shape of the holding portion 380 of the contact 300A and a recessed portion formed by the inverted C shape of the holding portion 380 of the contact 300B face each other. Further, a recessed portion formed by the C shape of the holding portion 380 of the contact 300C and a recessed portion formed by the inverted C shape of the holding portion 380 of the contact 300D also face each other.

The third section 350 is disposed in a corresponding third groove portion 50. The third section 350 extends downward from the lower end portion 383 of the holding portion 380, and is further curved at the lower end and extends rearward with an upward inclination. A length of the third section 350 extending downward from the lower end portion 383 is equal to a length of the second section 330 extending upward from the upper end portion 382. A rear end of the third section 350 is a second contact portion 360. A tip of the second contact portion 360 is inclined downward.

The housing 100 has a configuration in which a housing front portion 10 and a housing rear portion 30 are integrated. The housing 100 is formed of, for example, a resin material having insulating properties. As illustrated in FIG. 2, the housing front portion 10 has a bottom wall 10*a* extending along an XY plane and a pair of side walls 10*b*, 10*c* extending upward from both right and left sides of the bottom wall 10*a*. A plurality of first groove portions 20 disposed to be adjacent to each other are formed in an upper surface of the bottom wall 10*a*. The plurality of first groove portions 20 extend straight along the Y-axis direction from one end to the other end of the Y-axis direction. The plurality of first groove portions 20 are disposed at intervals therebetween and substantially parallel to each other. In one embodiment, the plurality of first groove portions 20 are four first groove portions 20A to 20D. As illustrated, an interval in the X-axis direction between the first groove portion 20A and the first groove portion 20B and an interval in the X-axis direction between the first groove portion 20C and the first groove portion 20D are smaller than an interval in the X-axis direction between the first groove portion 20B and the first groove portion 20C. The first section 310 of the corresponding contact 300 is disposed in each of the first groove portions 20 (see FIG. 6).

An engagement portion 11 and an engagement portion 12 are formed in each of inner surfaces of the side walls 10*b*, 10*c*. The engagement portion 11 and the engagement portion 12 protrude along the X-axis direction from the each of inner surfaces of the side walls 10*b*, 10*c*. The engagement portion 12 is provided in a front portion and an upper portion of each of the side walls 10*b*, 10*c*. The engagement portion 11 is formed below the corresponding engagement portion 12. The engagement portion 12 and the engagement portion 11 are disposed to partially overlap each other in the Y-axis direction.

Figure 4:
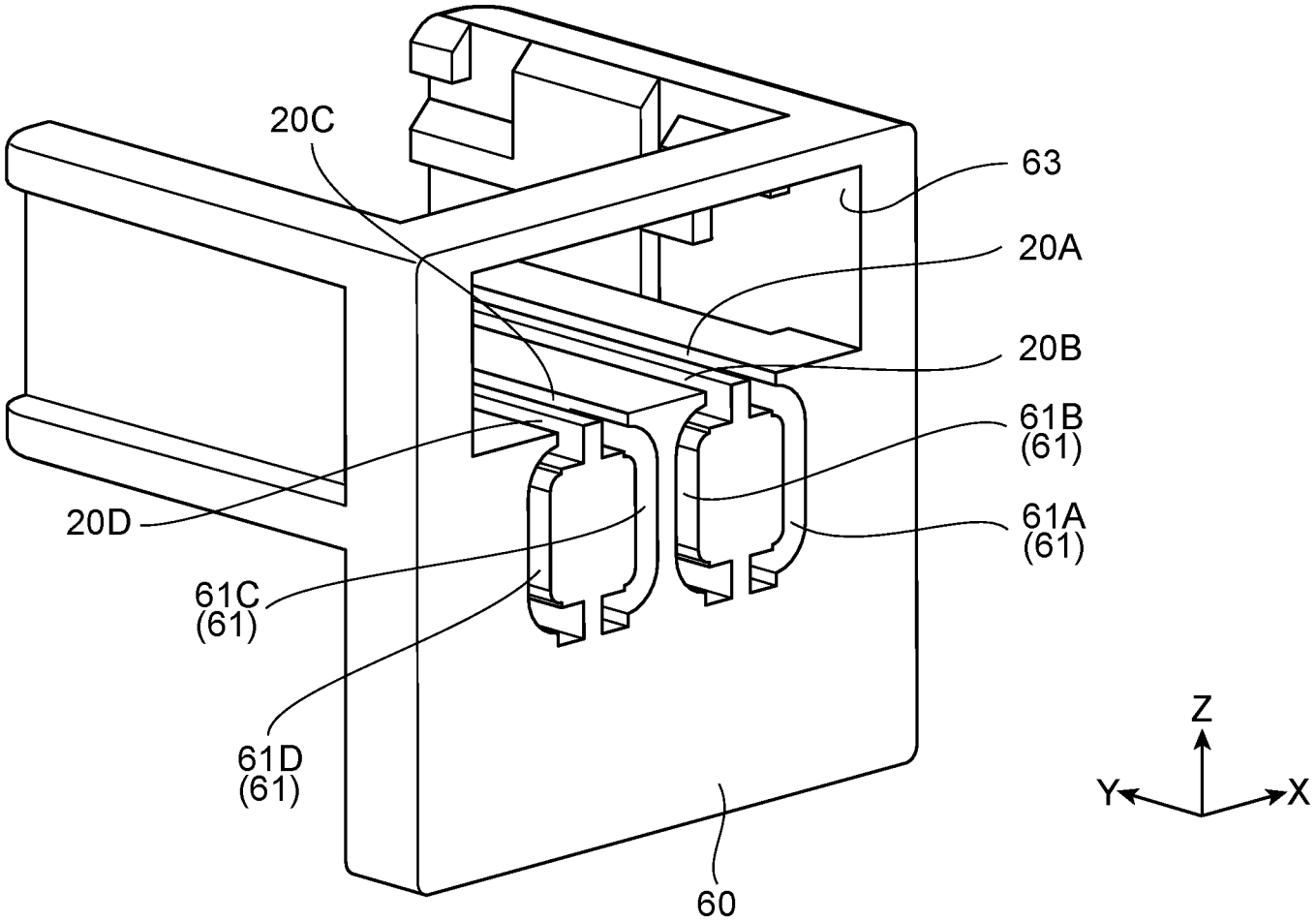
FIG. 4 is a perspective view illustrating a housing front portion.

FIG. 4 is a perspective view illustrating the housing front portion. A rear wall (central wall portion) 60 is provided integrally with a rear end of the housing front portion 10. The rear wall 60 faces a front end of the housing rear portion 30. In other words, the rear wall 60 extends along an XZ plane. The rear wall 60 extends from the same position as the upper ends of the side walls 10*b*, 10*c* and beyond the lower ends of the side walls 10*b* and 10*c*. As illustrated in FIG. 4, the rear wall 60 has a rectangular opening 63 that is located between the pair of the side walls 10*b*, 10*c* and above the bottom wall 10*a* and penetrates the rear wall 60. Further, a plurality of housing portions (openings) 61 are formed in the rear wall 60, each of the housing portions (openings) 61 being connected to corresponding one of the plurality of first groove portions 20. Each of the housing portions 61 has a groove shape recessed in the Y-axis direction relative to the rear wall 60, and is opened toward the rear. The plurality of housing portions 61 are disposed to be adjacent to each other in the X-axis direction.

Each of the housing portions 61 has substantially the same shape as that of the corresponding holding portion 380 such that the holding portion 380 of the contact 300 can be housed. In other words, each of the housing portions 61 has the C shape or the inverted C shape. In the example of FIG. 4, the plurality of housing portions 61 are four housing portions 61A to 61D. When the housing portions 61A to 61D are seen from the housing rear portion 30 side, the housing portions 61A. 61C have the inverted C shape while the housing portions 61B, 61D have the C shape. In the illustrated example, upper ends of the housing portions 61 are connected to rear ends of the first groove portions 20.

Figure 5:
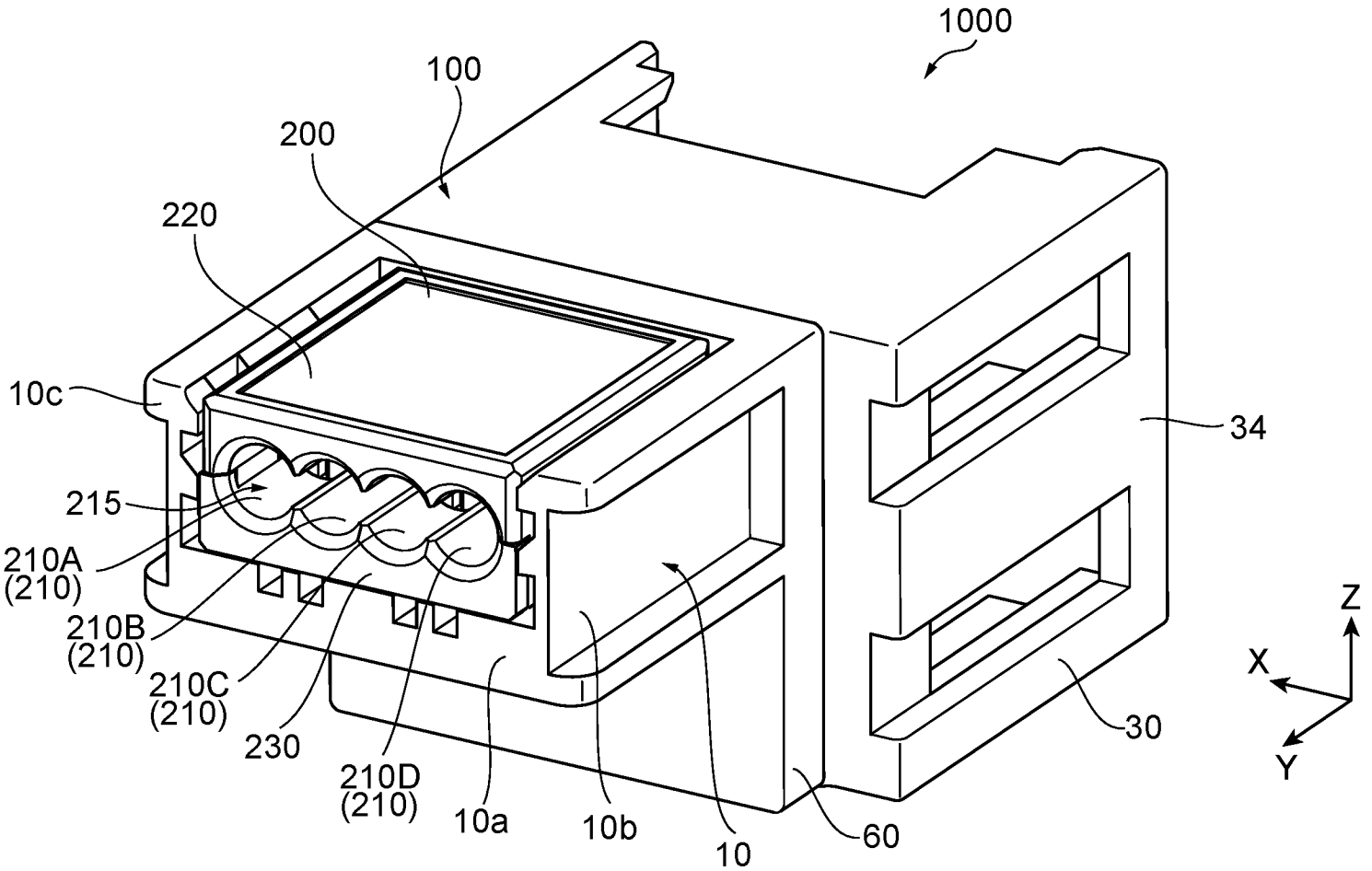
FIG. 5 is a perspective view illustrating a connector according to one embodiment.
Figure 6:
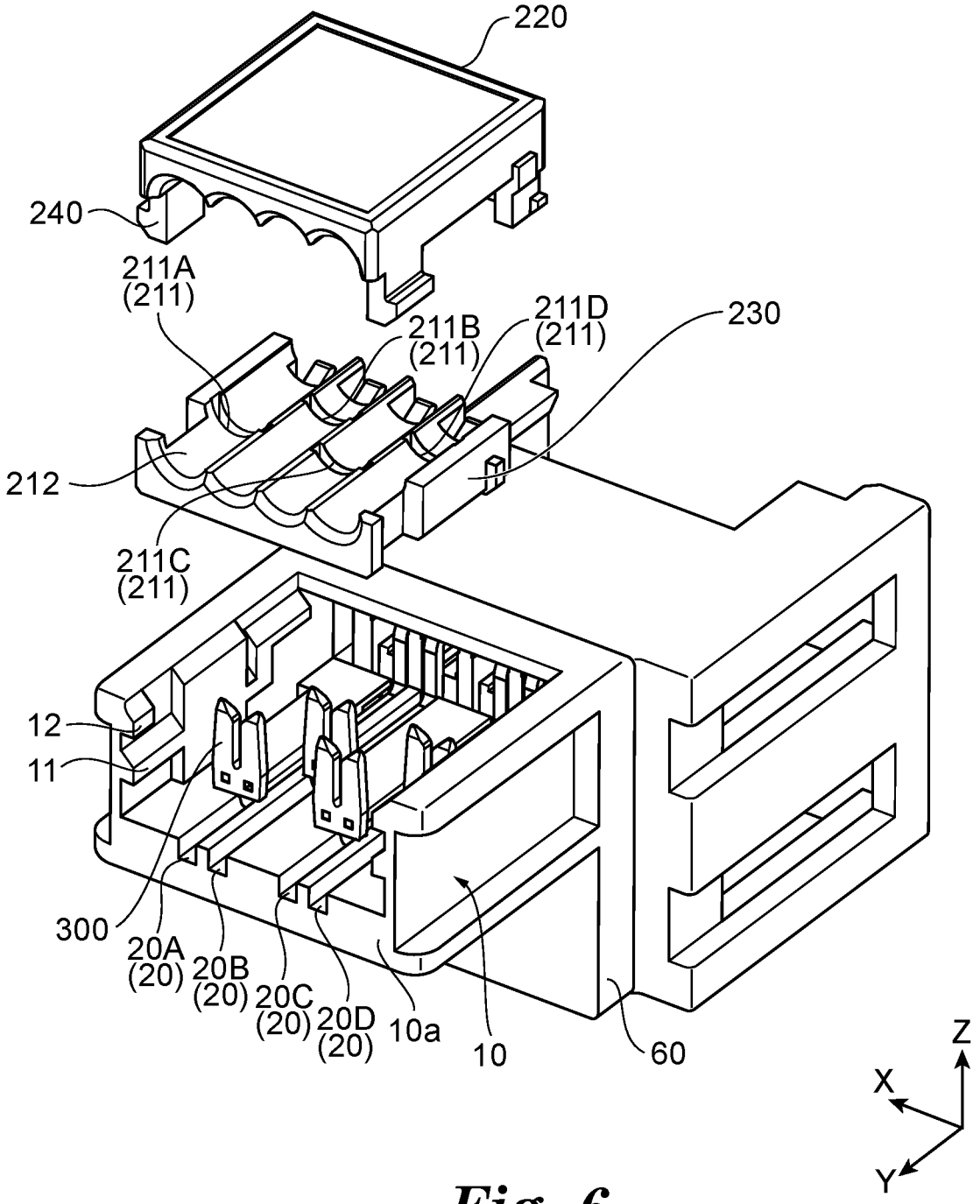
FIG. 6 is an exploded perspective view illustrating the connector of FIG. 5.
Figure 7:
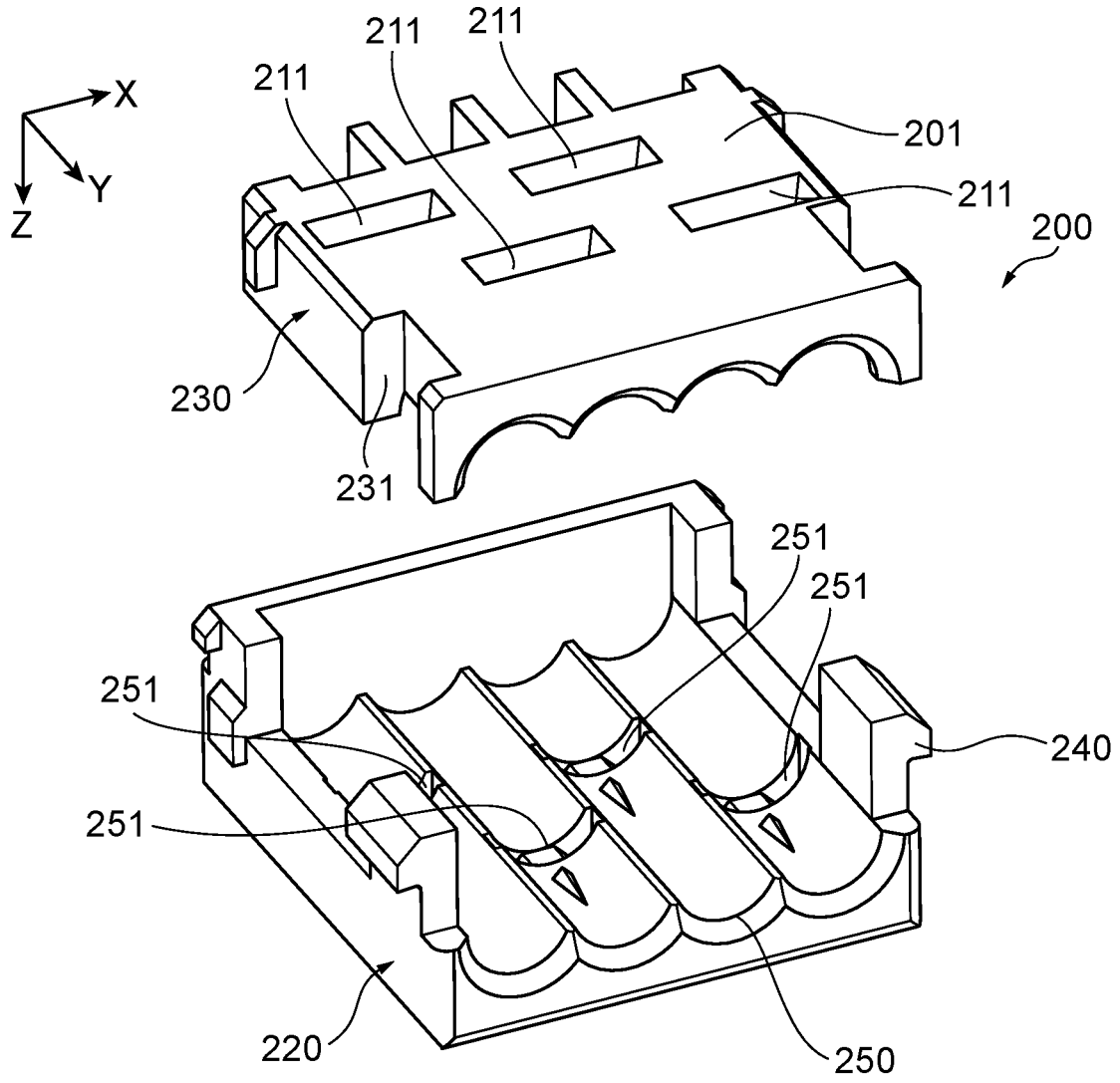
FIG. 7 is an exploded perspective view illustrating a part of the connector of FIG. 5.

The cover 200 is combined detachably with the housing front portion 10. The cover 200 is formed of, for example, a resin material having insulating properties. FIG. 5 is a perspective view illustrating the connector. FIG. 6 is an exploded perspective view illustrating the connector. FIG. 7 is an exploded perspective view illustrating the cover. Note that the XYZ orthogonal coordinate system is set such that a cover lower portion 230 is on the upper side of the paper plane and a cover upper portion 220 is on the lower side of the paper plane in FIG. 7. As illustrated in FIGS. 5 to 7, the cover 200 includes the cover lower portion 230 and the cover upper portion 220 disposed on the cover lower portion 230. A plurality of fourth groove portions 210 disposed to be adjacent to each other in the X-axis direction and substantially parallel to each other are formed in the cover lower portion 230. The plurality of fourth groove portions 210 extend along the Y-axis direction. The plurality of fourth groove portions 210 are four fourth groove portions 210A to 210D. A through hole 211 penetrating from a top surface 212 of each of the fourth groove portions 210 to a bottom surface 201 of the cover is formed in each of the fourth groove portions 210. In the illustrated example, the plurality of through holes 211 are disposed in the staggered pattern. In other words, through holes 211A, 211C are located in front of through holes 211B, 211D. A plurality of fifth groove portions 250 disposed to be adjacent to each other and substantially parallel to each other are formed in the cover upper portion 220. Each of the fifth groove portions 250 is aligned with the corresponding fourth groove portion 210 and faces the fourth groove portion 210. While the cover lower portion 230 and the cover upper portion 220 are combined together, the fourth groove portions 210 and the fifth groove portions 250 corresponding to each other form holes 215 having a circular cross section. The wires 370 may be inserted into the holes 215 along the fourth groove portions 210 and the fifth groove portions 250. The wires 370 are electric wire covered by a member formed of an insulator. As an example, each wire 370 may have an outer diameter from about 1.6 to 2.0 mm. A hole 251 is formed in each of the fifth groove portions 250 so as to face the through hole 211 of the corresponding fourth groove portion 210.

The cover upper portion 220 includes latches 240 that engage the cover upper portion 220 with the housing front portion 10. The latches 240 are formed in positions corresponding to the positions of the engagement portion 12 and the engagement portion 11 in the Y-axis direction. The cover 200 can be in a temporarily fixed state of being temporarily fixed to the housing front portion 10 and in a fixed state of being fixed to the housing front portion 10. In the temporarily fixed state, the latches 240 of the cover upper portion 220 are engaged with the engagement portions 12. In the fixed state, the latches 240 of the cover upper portion 220 are engaged with the engagement portions 11.

A vertical groove 231 into which the portion of the latch 240 of the cover upper portion 220 is fitted is formed in each side surface of the cover lower portion 230. While the cover lower portion 230 and the cover upper portion 220 are combined together, movement of the cover upper portion 220 in the Y-axis direction relative to the cover lower portion 230 is restricted by fitting the cover upper portion 220 into the vertical grooves 231.

Figure 9:
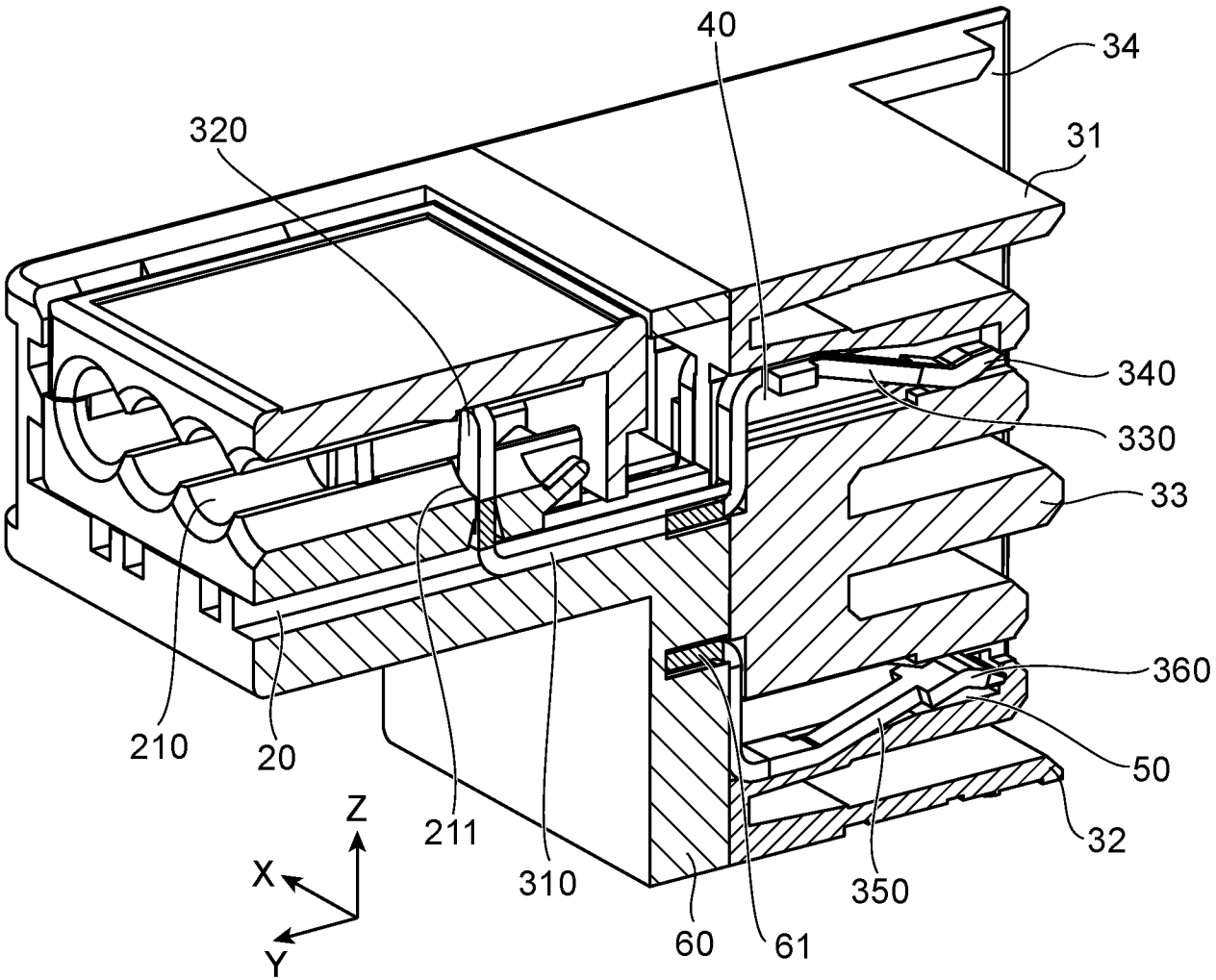
FIG. 9 is a cross-sectional perspective view illustrating the connector of FIG. 5.

The pressure connection portion 320 is disposed in the through hole 211 of the corresponding fourth groove portion 210 in the housing front portion 10 (see FIG. 9). With the cover 200 in the temporarily fixed state, the pressure connection portion 320 is almost housed in the through hole 211. With the cover 200 in the fixed state, the pressure connection portion 320 protrudes from the through hole 211 into the fourth groove portion 210. The upper end of the pressure connection portion 320 may be disposed in the hole 251 of the corresponding fifth groove portion 250. In other words, the pressure connection portion 320 of the corresponding contact 300 may be disposed in the through hole 211 of the corresponding fourth groove portion 210 and the hole 251 of the corresponding fifth groove portion 250. When the wires 370 are inserted into the holes 215 of the cover 200, the pressure connection portion 320 may accommodate a conductive portion of each of the wires 370 between the pair of pressure contacting blades 320*a* and be in contact with the conductive portion. In other words, each of the wires 370 is disposed in the corresponding fourth groove portion 210 of the cover 200 and can come in electrical contact with the pressure connection portion 320 of the corresponding contact 300.

Figure 8:
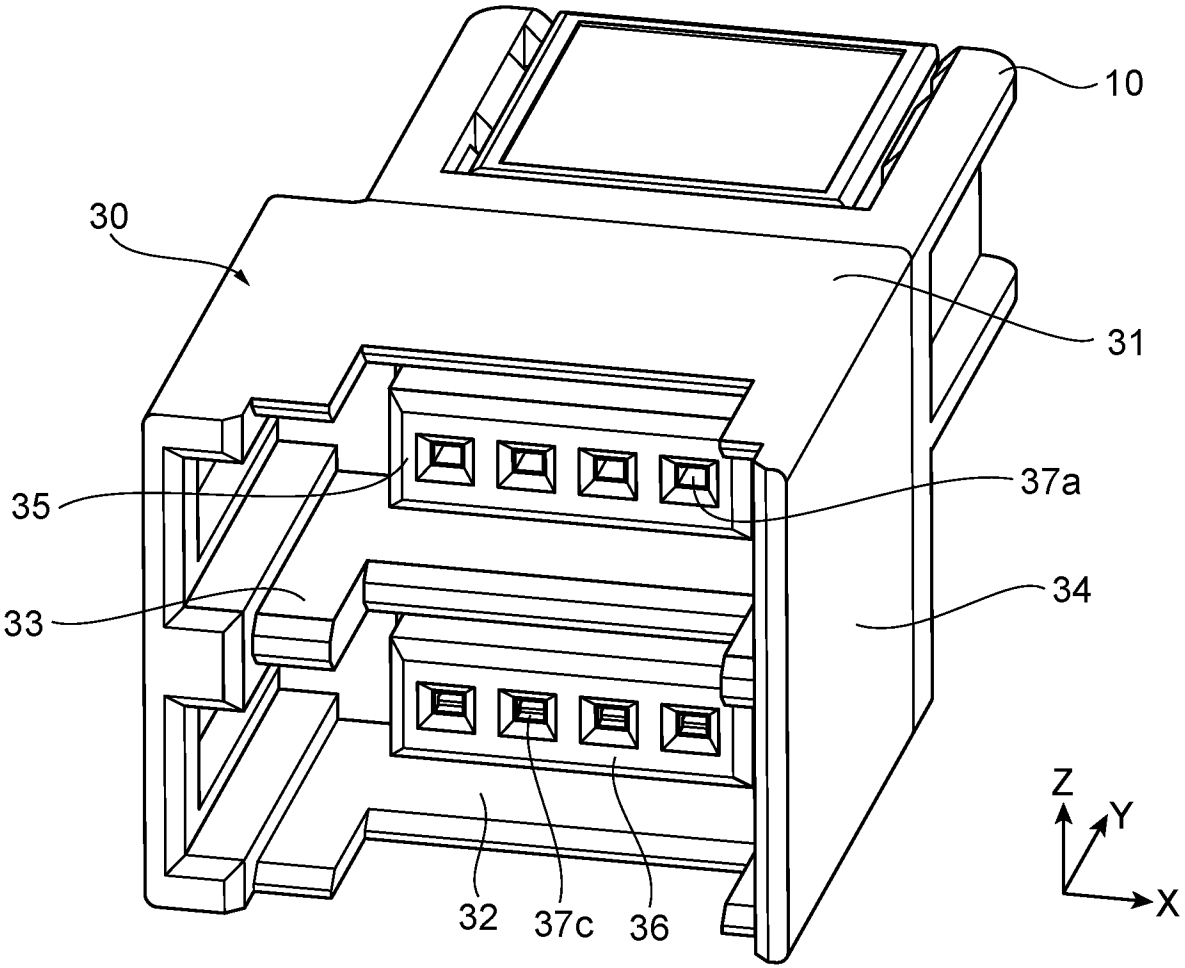
FIG. 8 is a perspective view illustrating the connector of FIG. 5.

FIG. 8 is a perspective view illustrating the connector. FIG. 9 is a cross-sectional perspective view illustrating the connector. As illustrated in FIGS. 2, 8, and 9, the housing rear portion 30 includes a front wall 37, an upper wall 31, a partition wall 33, a lower wall 32, and a pair of side walls 34. The front wall faces the rear wall 60 of the housing front portion 10. While the housing front portion 10 and the housing rear portion 30 are integrated, the front wall abuts the rear wall 60. For example, the housing front portion 10 and the housing rear portion 30 may be integrated with an engagement hook or the like.

The upper wall 31, the partition wall 33, and the lower wall 32 extend along the XY plane. The pair of the side walls 34 extend along a YZ plane. The position of an upper end of the rear wall 60 is flush with the position of an upper surface of the upper wall 31. The position of a lower end of the rear wall 60 is flush with the position of a lower surface of the lower wall 32. The partition wall 33 is located between the upper wall 31 and the lower wall 32 in the Z-axis direction. The housing rear portion 30 has a housing upper rear portion 35 and a housing lower rear portion 36. In the housing rear portion 30, the partition wall 33 isolates the housing upper rear portion 35 and the housing lower rear portion 36 from each other.

Figure 10:
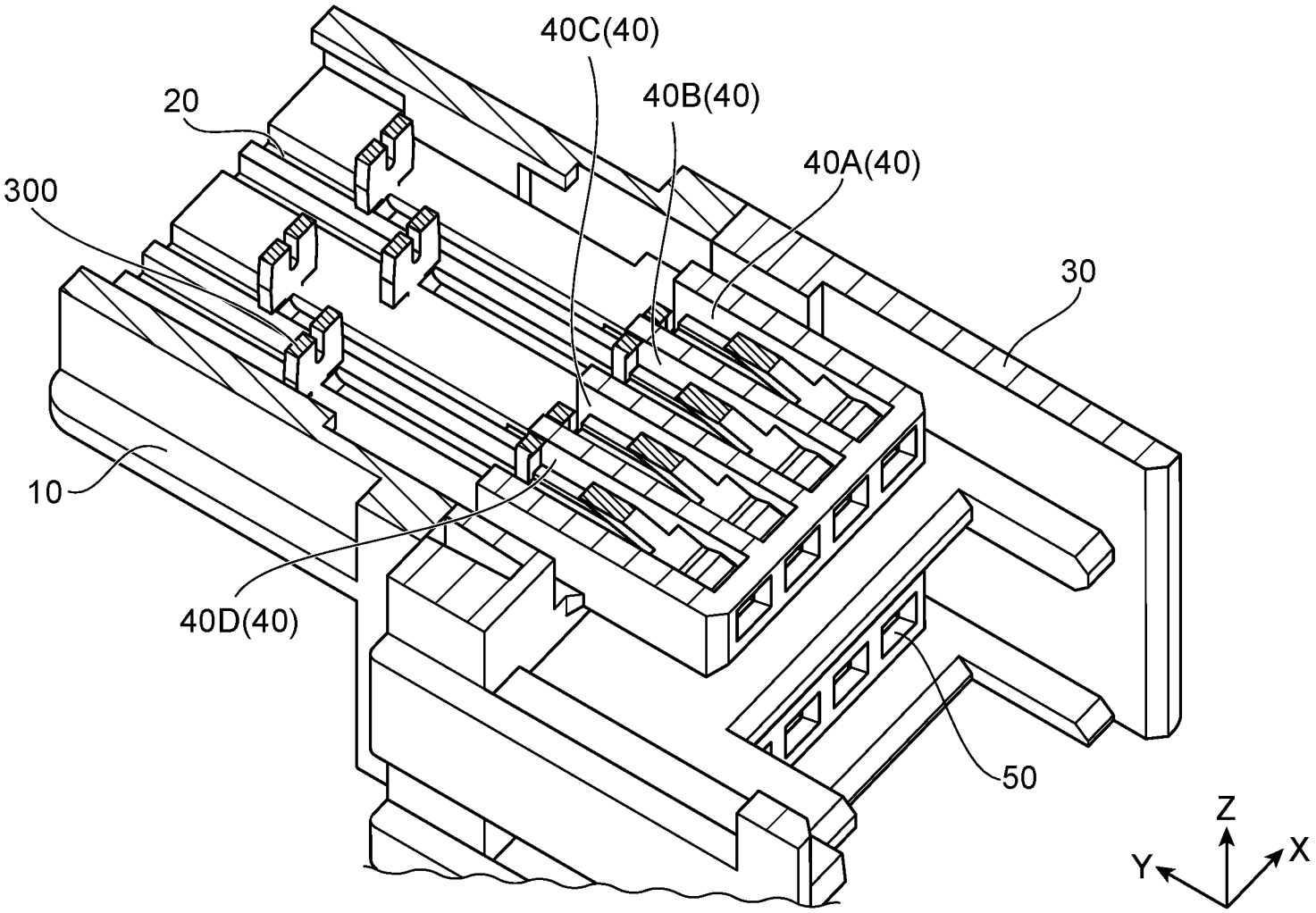
FIG. 10 is a cross-sectional perspective view illustrating the connector of FIG. 5.

The housing upper rear portion 35 protrudes rearward from the front wall 37 and functions as a plug. In other words, the housing upper rear portion 35 may be engaged with the upper engagement connector 600. The housing upper rear portion 35 is formed above the center of the housing rear portion 30 in the up-and-down direction. The housing upper rear portion 35 and the upper wall 31, the partition wall 33, the side walls 34 have a predetermined interval therebetween. FIG. 10 is a cross-sectional perspective view illustrating the connector. As illustrated in FIG. 10, a plurality of second groove portions 40 are formed in the housing upper rear portion 35. In the illustrated example, the plurality of second groove portions 40 are four second groove portions 40A to 40D. The plurality of second groove portions 40 are formed by a plurality of through holes 37*a* penetrating the front wall 37 and the housing upper rear portion 35 along the Y-axis direction. The plurality of second groove portions 40 are offset from and located above the plurality of first groove portions 20 and are disposed to be adjacent to each other in the X-axis direction. The plurality of second groove portions 40 are substantially parallel to each other. A partition 37*b* divides the second groove portions 40 adjacent to each other. The second section 330 of the corresponding contact 300 is disposed in each of the second groove portions 40. The first contact portion 340 disposed in the housing upper rear portion 35 may be in contact with a corresponding contact 610 (terminal 630) of the upper engagement connector 600 (first engagement connector) engaged with the housing rear portion 30.

Figure 11:
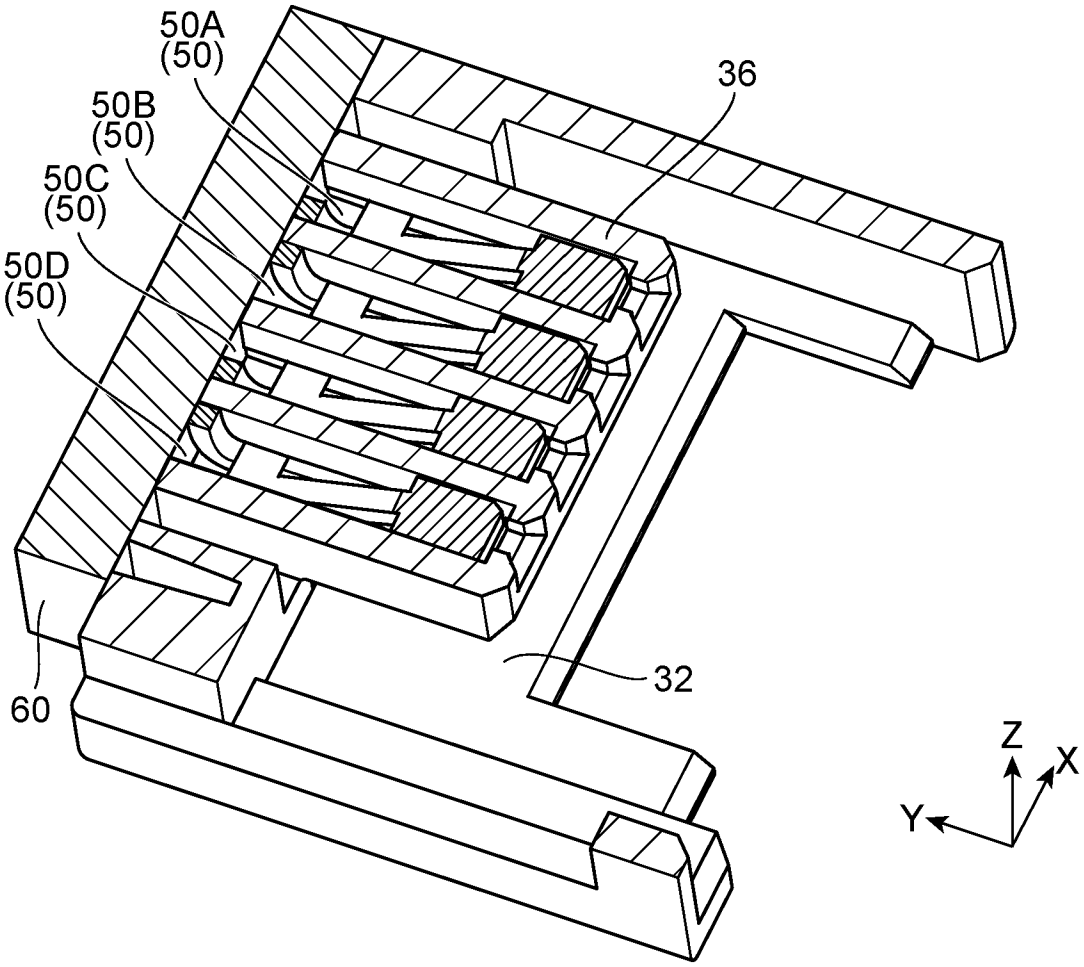
FIG. 11 is a cross-sectional perspective view illustrating the connector of FIG. 5.

The housing lower rear portion 36 protrudes rearward from the front wall 37 and functions as a plug. In other words, the housing lower rear portion 36 may be engaged with the lower engagement connector 700. The housing lower rear portion 36 is formed below the center of the housing rear portion 30 in the up-and-down direction. The housing lower rear portion 36 and the lower wall 32, the partition wall 33, the side walls 34 have a predetermined interval therebetween. FIG. 11 is a cross-sectional perspective view illustrating the connector. As illustrated in FIG. 11, the plurality of third groove portions 50 are formed in the housing lower rear portion 36. In the illustrated example, the plurality of third groove portions 50 are four third groove portions 50A to 50D. The plurality of third groove portions 50 are formed by a plurality of through holes 37*c* penetrating the front wall 37 and the housing lower rear portion 36 along the Y-axis direction. The plurality of third groove portions 50 are offset from and located below the plurality of first groove portions 20 and are disposed to be adjacent to each other in the X-axis direction. The plurality of third groove portions 50 are substantially parallel to each other. A partition 37*d* divides the third groove portions 50 adjacent to each other. The third section 350 of the corresponding contact 300 is disposed in each of the third groove portions 50. The second contact portion 360 disposed in the housing lower rear portion 36 may be in contact with a corresponding contact 710 (terminal 730) of the lower engagement connector 700 (second engagement connector) engaged with the housing rear portion 30.

Figure 12:
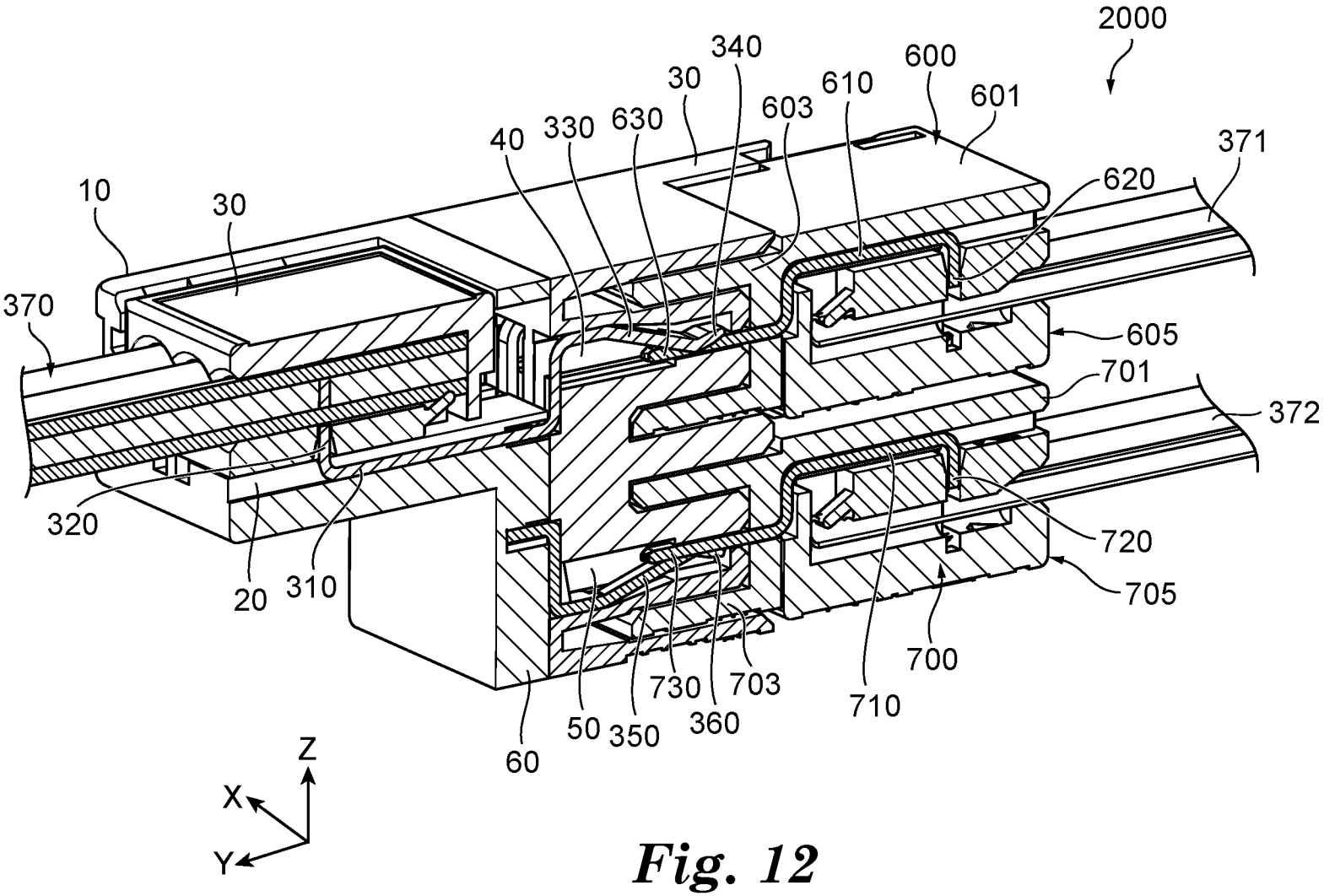
FIG. 12 is a cross-sectional perspective view illustrating the connector assembly of FIG. 1.

FIG. 12 is a cross-sectional perspective view illustrating the connector assembly. As illustrated in FIG. 12, the upper engagement connector 600 includes a socket 601 engaged with the housing upper rear portion 35 and a cover 605 fit to the socket 601. The cover 605 has the same configuration as that of the cover 200. The contact (upper contact) 610 is inserted into the cover 605. The contact 610 is held by the socket 601. The contact 610 includes a pressure connection portion 620 and the terminal 630. The pressure connection portion 620 is one end of the contact 610 and a portion pressure contacted with the wire 371 inserted into the cover 605. The terminal 630 is the other end of the contact 610. The terminal 630 is exposed in an inner space of a connection frame 603 forming the front side of the socket 601. The connection frame 603 may be fitted to the housing upper rear portion 35. While the connection frame 603 and the housing upper rear portion 35 are fitted together, the terminal 630 is inserted into the second groove portion 40 and electrically connected to the first connection portion 340 of the corresponding contact 300.

The lower engagement connector 700 includes a socket 701 engaged with the housing lower rear portion 36 and a cover 705 fit to the socket 701. The cover 705 has the same configuration as that of the cover 200. The contact (lower contact) 710 is inserted into the cover 705. The contact 710 is held by the socket 701. The contact 710 includes a pressure connection portion 720 and the terminal 730. The pressure connection portion 720 is one end of the contact 710 and a portion pressure welded by the wire 372 inserted into the cover 705. The terminal 730 is the other end of the contact 710. The terminal 730 is exposed in an inner space of a connection frame 703 forming the front side of the socket 701. The connection frame 703 may be fitted to the housing lower rear portion 36. While the connection frame 703 and the housing lower rear portion 36 are fitted together, the terminal 730 is inserted into the third groove portion 50 and electrically connected to the second connection portion 360 of the corresponding contact 300.

As described above, in the connector 1000, the first groove portions 20A to 20D formed in the housing front portion 10 respectively correspond to the second groove portions 40A to 40D and the third groove portions 50A to 50D formed in the housing rear portion 30. The first section 310 of the contact 300 disposed in the first groove portion 20 is connected to the second section 330 disposed in the corresponding second groove portion 40 and the third section 350 disposed in the corresponding third groove portion 50. In this way, the first section 310 is electrically connected to the first connection portion 340 that comes in contact with the corresponding terminal 630 of the upper engagement connector 600 and the second connection portion 360 that comes in contact with the corresponding terminal 730 of the lower engagement connector 700. Further, the first groove portions 20A to 20D respectively correspond to the fourth groove portions 210A to 210D, and the pressure connection portions 320 connected to the first sections 310 are disposed in the through holes 211A to 211D respectively provided in the fourth groove portions 210A to 210D. While the plurality of wires 370 corresponding to the plurality of respective fourth groove portions 210 are inserted into the cover 200, each of the wires 370 may be connected to the pressure connection portion 320 disposed in the through hole 211 of the corresponding fourth groove portion 210. While the wires 370 are accommodated by the housing front portion 10, and the housing upper rear portion 35 and the housing lower rear portion 36 are engaged with the corresponding upper engagement connector 600 and the corresponding lower engagement connector 700, each of the contacts 300 comes into contact with and electrically connects the corresponding wire 370, the terminal 630 of the upper engagement connector 600, and the terminal 730 of the lower engagement connector 700 to each other. In this way, a current flowing through each of the wires 370 branches into the corresponding terminal 630 of the upper engagement connector 600 and the corresponding terminal 730 of the lower engagement connector 700 via the contact 300. Therefore, wires needed for each of the upper engagement connector 600 and the lower engagement connector 700 can be reduced, and complicated wiring can thus be suppressed.

The housing 100 has the configuration in which the housing front portion 10 and the housing rear portion 30 are integrated, and thus, the man-hour for assembly can be reduced, and an error in wiring can also be suppressed. The number of parts can be reduced in comparison with a case where a known connector is used, and the whole connector can thus be reduced in size.

The housing 100 includes the rear wall 60 located between the housing front portion 10 and the housing rear portion 30. The plurality of housing portions 61 communicating with the first groove portions 20 and disposed to be adjacent to each other are formed in the rear wall 60. The holding portion 380 of the contact 300 is disposed in the corresponding housing portion 61. Thus, the contact 300 can be held and fixed in the housing 100.

Each of the housing portions 61 has the C shape or the inverted C shape. The holding portion 380 of each of the contacts 300 has the C shape or the inverted C shape. This configuration allows movement of the holding portion 380 disposed in the housing portion 61 to be restricted in the up-and-down direction and the left-and-right direction. Thus, the contact 300 can be stably held in the housing 100.

In at least the pair of the contacts 300 adjacent to each other of the plurality of contacts 300, the holding portion 380 of one of the contacts 300 has the C shape forming a recessed portion while the holding portion 380 of the other contact 300 has the inverted C shape forming a recessed portion. The recessed portions of the holding portions 380 face each other. The holding portions 380 of the pair of the contacts 300 have shapes different from each other, and thus, the contacts can be prevented from switching places during assembly.

The cover 200 includes the cover lower portion 230 in which the fourth groove portions 210 are formed and the cover upper portion 220 disposed on the cover lower portion 230. This configuration allows the cover upper portion 220 and the cover lower portion 230 to sandwich the wires 370 inserted into the cover 200.

The cover upper portion 220 includes the latches 240 that engage the cover upper portion 220 with the housing front portion 10. The cover lower portion 230 is fixed between the cover upper portion 220 and the housing front portion 10 by the engagement of the latches 240. The latches 240 are engaged with the engagement portions 11 of the housing front portion 10. This configuration allows the cover upper portion 220 to press the cover lower portion 230 downward. Thus, the cover upper portion 220 and the cover lower portion 230 can more firmly sandwich the wires 370 inserted into the cover 200.

The pressure connection portion 320 of the contact 300 may be disposed in the through hole 211 of the corresponding fourth groove portion 210 and the hole 251 of the corresponding fifth groove portion 250. According to this configuration, the upper end of the pressure connection portion 320 that accommodates the wire 370 inserted into the cover 200 is disposed in the hole 251. This allows the movement of the pressure connection portion 320 to be restricted in the anterior-and-posterior direction, thereby preventing the wire 370 from being pulled out.

The contact 300 includes the pressure connection portion 320 disposed in front of the holding portion 380 and the first connection portion 340 and the second connection portion 360 disposed in the rear of the holding portion 380. When the plurality of wires 370 are accommodated by the housing front portion 10, and the housing upper rear portion 35 and the housing lower rear portion 36 are engaged with the corresponding upper engagement connector 600 and the corresponding lower engagement connector 700, each of the contacts 300 comes into contact with and electrically connects the corresponding wire 370 and the terminals 630, 730 of the upper engagement connector 600 and the lower engagement connector 700 to each other. In this way, an electric signal (current) can be divided into two wires from one side to the other side of the anterior-and-posterior direction.

Further, the partition wall 33 is provided between the housing upper rear portion 35 and the housing lower rear portion 36. Thus, the housing upper rear portion 35 and the housing lower rear portion 36 can be reliably isolated from each other.

While the embodiment of the present invention has been described in detail with reference to the drawings, the specific configuration is not limited to this embodiment.

For example, the example in which one housing includes two plugs of the housing upper rear portion and the housing lower rear portion is illustrated, but this is not restrictive. Three or more plugs may be formed in one housing.

Further, the example in which four wires are inserted into one cover is illustrated, but this is not restrictive. The number of wires inserted into one cover may be less than four, or four or more.

REFERENCE NUMERALS

10 Housing front portion
20 First groove portion

30 Housing rear portion
40 Second groove portion
50 Third groove portion
100 Housing
200 Cover
210 Fourth groove portion
211 Through hole
300 Contact
310 First section
320 Pressure connection portion
330 Second section
350 Third section
370 Wire (first wire)
1000 Connector
600 Upper engagement connector (first engagement connector)
700 Lower engagement connector (second engagement connector)
2000 Connector assembly

The invention claimed is:

1. A connector comprising:

a housing including a housing front portion including a plurality of first groove portions disposed to be adjacent to each other, and a housing rear portion including a plurality of second groove portions offset from and located above the plurality of first groove portions and disposed to be adjacent to each other and a plurality of third groove portions offset from and located below the plurality of first groove portions and disposed to be adjacent to each other;

a cover configured to be combined detachably with the housing front portion, including a plurality of fourth groove portions disposed to be adjacent to each other, and including a through hole penetrating from a top surface of each of the fourth groove portions to a bottom surface of the cover; and a plurality of contacts each including a pressure connection portion disposed in the through hole of a corresponding fourth groove portion among the plurality of fourth groove portions and configured to come in contact with a wire inserted into the cover, a first section connected to the pressure connection portion and disposed in a corresponding first groove portion among the plurality of first groove portions, a second section connected to the first section, disposed in a corresponding second groove portion among the plurality of second groove portions, and including, at an end, a first contact portion that comes in contact with a corresponding terminal of a first engagement connector configured to be engaged with the housing rear portion, and a third section connected to the first section, disposed in a corresponding third groove portion among the plurality of third groove portions, and including, at an end, a second contact portion that comes in contact with a corresponding terminal of a second engagement connector configured to be engaged with the housing rear portion.

2. The connector according to claim 1, wherein the housing has a configuration in which the housing front portion and the housing rear portion are integrated.

3. The connector according to claim 1, wherein the housing includes a central wall portion located between the housing front portion and the housing rear portion, and a plurality of openings communicating with the plurality of first groove portions and disposed to be adjacent to each other are formed in the central wall portion.

4. The connector according to claim 3, wherein each of the plurality of openings has a C shape or an inverted C shape.

5. The connector according to claim 3, wherein each of the plurality of contacts further includes a holding portion configured to hold and fix each of the plurality of contacts in the housing, and the holding portion is disposed in a corresponding opening among the plurality of openings in the central wall portion.

6. The connector according to claim 5, wherein the holding portion of each of the plurality of contacts has a C shape or an inverted C shape.

7. The connector according to claim 5, wherein in at least a pair of a first contact and a second contact adjacent to each other of the plurality of contacts, a holding portion of the first contact has a C shape forming a recessed portion, a holding portion of the second contact has an inverted C shape forming a recessed portion, and the recessed portion of the holding portion of the first contact and the recessed portion of the holding portion of the second contact face each other.

8. The connector according to claim 1, wherein the cover includes a cover lower portion including the plurality of fourth groove portions formed in the cover lower portion and a cover upper portion disposed on the cover lower portion.

9. The connector according to claim 8, wherein the cover upper portion includes a latch configured to engage the cover upper portion with the housing front portion, and the cover lower portion is configured to be fixed between the cover upper portion and the housing front portion by engagement of the latch.

10. The connector according to claim 9, wherein the latch is configured to be engaged with an engagement portion of the housing front portion.

11. The connector according to claim 1, wherein the cover further includes fifth groove portions disposed to be adjacent to each other, each of the fifth groove portions is configured to be aligned with a corresponding fourth groove portion among the plurality of fourth groove portions and face the corresponding fourth groove portion, and a hole is formed in each of the fifth groove portions and is configured to face the through hole of the corresponding fourth groove portion, and the pressure connection portion of a corresponding contact among the plurality of contacts is disposed in the through hole of the corresponding fourth groove portion and the hole of a corresponding fifth groove portion among the fifth groove portions.

12. A connector assembly comprising:

the connector according to claim 1;

a plurality of first wires inserted into the cover, each of the plurality of first wires being disposed in a corresponding fourth groove portion among the plurality of fourth groove portions of the cover and being in contact with the pressure connection portion of the first section of a corresponding contact of the plurality of contacts;

an upper engagement connector engaged with the connector and including a plurality of upper contacts, each of the plurality of upper contacts being in contact with the first contact portion of a corresponding contact among the plurality of contacts of the connector; and a lower engagement connector engaged with the connector and including a plurality of lower contacts, each of the plurality of lower contacts being in contact with the second contact portion of a corresponding contact among the plurality of contacts of the connector, wherein each of the plurality of contacts of the connector is electrically connected to a corresponding upper contact among the plurality of upper contacts and a corresponding lower contact among the plurality of lower contacts.

13. The connector assembly according to claim 12 further comprising:

a plurality of second wires inserted into the upper engagement connector, each of the plurality of second wires being in contact with a pressure connection portion of a corresponding upper contact among the plurality of upper contacts; and a plurality of third wires inserted into the lower engagement connector, each of the plurality of third wires being in contact with a pressure connection portion of a corresponding lower contact among the plurality of lower contacts.

14. A contact having electrical conductivity comprising:

a holding portion having a C shape or an inverted C shape when seen along an anterior-and-posterior direction, the holding portion ending with an upper end portion and a lower end portion;

a first section extending forward from the upper end portion of the holding portion;

a pressure connection portion extending upward from a front end of the first section and configured to accommodate a wire and come in contact with the wire;

a second section extending upward from the upper end portion of the holding portion, further extending rearward from an upper end, and ending with a first contact portion; and a third section extending downward from the lower end portion of the holding portion, further extending rearward from a lower end, and ending with a second contact portion.

15. The contact according to claim 14, wherein in a case that the contact is used in an electrically conductive connector, the first contact portion is configured to be engaged with a corresponding contact of an upper engagement connector, and the second contact portion is configured to be engaged with a corresponding contact of a lower engagement connector different from the upper engagement connector.

16. A connector comprising:

a housing having an integrated configuration, the housing including a housing front portion configured to accommodate a plurality of wires, and a housing rear portion including a housing upper rear portion configured to be engaged with an upper engagement connector and a housing lower rear portion configured to be engaged with a lower engagement connector; and a plurality of contacts, each of the plurality of contacts having an integrated configuration and including a pressure connection portion disposed in the housing front portion, a first contact portion disposed in the housing upper rear portion, and a second contact portion disposed in the housing lower rear portion, wherein in a case that the plurality of wires are accommodated by the housing front portion, and the housing upper rear portion and the housing lower rear portion are engaged with the upper engagement connector and the lower engagement connector, respectively, each of the plurality of contacts comes into contact with and electrically connects a corresponding wire among the plurality of wires and corresponding terminals of the upper engagement connector and the lower engagement connector to each other.

17. The connector according to claim 16, wherein the housing includes a partition wall isolating the housing upper rear portion and the housing lower rear portion from each other.

* * * * *